United States Patent [19]

Iino et al.

[11] Patent Number: 4,738,912

[45] Date of Patent: Apr. 19, 1988

[54] PHOTOSENSITIVE MEMBER HAVING AN AMORPHOUS CARBON TRANSPORT LAYER

[75] Inventors: Shuji Iino, Hirakata; Hideo Hotomi, Suita; Izumi Osawa, Ikeda; Mitsutoshi Nakamura, Osaka, all of Japan

[73] Assignee: Minolta Camera Kabushiki Kaisha, Osaka, Japan

[21] Appl. No.: 905,540

[22] Filed: Sep. 10, 1986

[30] Foreign Application Priority Data

Sep. 13, 1985 [JP] Japan ..... 60-204154
Sep. 19, 1985 [JP] Japan ..... 60-207895
May 17, 1986 [JP] Japan ..... 61-112847

[51] Int. Cl.[4] ..... G03G 5/14

[52] U.S. Cl. ..... 430/58

[58] Field of Search ..... 430/58, 60, 61, 62, 430/63, 64, 65

[56] References Cited

U.S. PATENT DOCUMENTS

| | | | |
|---|---|---|---|
| 3,956,525 | 5/1976 | Yasuba | 427/41 |
| 4,365,013 | 12/1982 | Ishioka et al. | 430/57 |
| 4,376,688 | 3/1983 | Ceasar et al. | 204/192 |
| 4,394,426 | 7/1983 | Shimizu et al. | 430/65 |
| 4,409,308 | 10/1988 | Shimizu et al. | 430/60 |
| 4,416,755 | 11/1983 | Caesar et al. | 204/192 |
| 4,451,546 | 5/1984 | Kawamura et al. | 430/69 |
| 4,452,874 | 6/1984 | Ogawa et al. | 430/57 |
| 4,465,750 | 8/1984 | Ogawa et al. | 430/57 |
| 4,466,380 | 8/1984 | Jansen et al. | 118/712 |
| 4,471,042 | 9/1984 | Komatzu et al. | 430/64 |
| 4,490,450 | 12/1984 | Shimizu et al. | 430/57 |
| 4,491,626 | 1/1985 | Kawamura et al. | 430/69 |
| 4,495,262 | 1/1985 | Matsuzaki et al. | 430/58 |
| 4,510,224 | 4/1985 | Yamazaki et al. | 430/57 |
| 4,513,022 | 4/1985 | Jansen et al. | 427/39 |
| 4,513,073 | 4/1985 | Jeffrey, III et al. | 430/65 |
| 4,518,670 | 5/1985 | Matsuzaki et al. | 430/58 |
| 4,522,905 | 6/1985 | Ogawa et al. | 430/60 |
| 4,544,617 | 10/1985 | Mort et al. | 430/58 |
| 4,557,987 | 12/1985 | Shirai et al. | 430/58 |
| 4,559,289 | 12/1985 | Sunagawa et al. | 430/66 |
| 4,579,801 | 4/1986 | Yashiki | 430/65 |
| 4,592,982 | 6/1986 | Saitoh et al. | 430/57 |
| 4,598,032 | 7/1986 | Saitoh et al. | 430/58 |
| 4,634,648 | 1/1987 | Jansen et al. | 430/84 |
| 4,686,164 | 8/1987 | Osawa et al. | 430/63 |

FOREIGN PATENT DOCUMENTS

| | | | |
|---|---|---|---|
| 194329 | 11/1979 | European Pat. Off. . | |
| 3525908 | 10/1978 | Fed. Rep. of Germany . | |
| 5660447 | 1/1977 | Japan . | |
| 60130747 | 6/1979 | Japan . | |
| 5146130 | 9/1979 | Japan . | |
| 5928161 | 11/1979 | Japan . | |
| 60125846 | 7/1980 | Japan . | |
| 61243460 | 11/1980 | Japan . | |
| 150753 | 1/1981 | Japan . | |
| 55-86169 | 3/1981 | Japan . | |
| 5938753 | 3/1981 | Japan . | |
| 115552 | 3/1982 | Japan . | |
| 171038 | 6/1983 | Japan . | |
| 88753 | 7/1983 | Japan . | |
| 154850 | 12/1983 | Japan . | |
| 136742 | 2/1984 | Japan . | |
| 214859 | 7/1984 | Japan . | |
| 137977 | 4/1985 | Japan | 430/65 |
| 63531 | 4/1985 | Japan . | |
| 63541 | 7/1985 | Japan . | |
| 61761 | 12/1985 | Japan . | |

OTHER PUBLICATIONS

"A C-NMR Investigation of Plasma Polymerized Ethane, Ethylene, and Acetylene", by A. Dilks, S. Kaplan, and A. Vanlaeken, Xerox Webster Research Center, Xerox Square, W-114, Rochester, N.Y. 14644.

Journal of Applied Polymer Science, vol. 17, pp. 885-892, (1973), Formation of an Amorphous Powder During the Polymerization of Ethylene in a Radio-Frequency Discharge.

*Primary Examiner*—John L. Goodrow

*Attorney, Agent, or Firm*—Burns, Doane, Swecker & Mathis

[57] ABSTRACT

The present invention provides a photosensitive member comprising a hydrogen-containing carbon layer as a charge transporting layer, which contains an element selected from the group consisting of Si, Ge and Sn; the hydrogen-containing carbon layer facilitates the injection of charge and decreases residual potential, and memory and increases sensitivity. Accordingly, a photosensitive member of the present invention is excellent in charge transporting property, sensitivity, charge holding property and imaged copy can be obtained.

6 Claims, 3 Drawing Sheets

PHOTOSENSITIVE MEMBER HAVING AN AMORPHOUS CARBON TRANSPORT LAYER

BACKGROUND OF THE INVENTION

The present invention relates to a photosensitive member, especially to a photosensitive member comprising a hydrogen-containing carbon layer with Si, Ge and/or Sn.

Recently, amorphous silicon (referred to as a-Si hereinafter) formed by a plasma chemical vapor deposition (referred to as plasma CVD) has been applied to produce a photosensitive member, especially an electrophotosensitive member.

A-Si photosensitive members have several excellent properties. But the relative dielectric constant ($\epsilon$) of a-Si is so larger (about 12) that it essentially needs a thickness of at least 25 $\mu$m to gain a sufficient surface potential for a photosensitive member. In addition, in the production of an a-Si photosensitive member by plasma CVD a long production time is needed because of a slow deposition rate of an a-Si layer. The long deposition time makes it difficult to obtain a homogeneous a-Si layer as the result of which image defects such as white spot noises are liable to occur in a high percentage. Further, the cost becomes expensive.

Though many attempts to improve the above defects have been made, it is not preferable to make the layers thinner.

On the other hand, an a-Si photosensitive member has additionaldefects such as weak adhesive strength between a-Si layer and electroconductive substrate, and poor resistances to corona, external circumstances and chemicals.

It has been proposed to use an organic polymeric layer produced by plasma polymerization (referred to as OPP layer hereinafter) and is arranged as either an overcoat layer or an undercoat layer in order to solve the above problems. The former is proposed, for instance, in U.S. Pat. No. 3,956,525 and the latter is done in Japanese Patent KOKAI No. 63541/1985.

It is known that an OPP layer can be produced from various kinds of organic compound such as ethylene gas, benzenes, aromatic silanes and the like (e.g. Journal of Applied Polymer Science Vol. 17, 885–892 (1973), by A. T. Bell et al.). However, the OPP layer produced by these conventional methods is restrictively used as an insulator. Therefore, the layer is considered as an insulating layer having an electrical resistance of about $10^{16}$ $\Omega$.cm as an ordinary polyethylene layer or at least similar to such a layer.

Recently, there is proposed a layer comprising diamond-like carbon in the semiconductor field. But charge transportability thereof has not been suggested at all.

U.S. Pat. No. 3,956,525 discloses a photosensitive member consisting of a substrate, a sensitizing layer, an organic photoconductive electrical insulator and a glow discharging polymer layer having a thickness of 0.1–1 $\mu$m in the above order. This polymer layer is provided to cover the surface so as to stand up to wet development as an overcoat. Carrier transportability of the layer is not suggested.

Japanese Patent KOKAI No. 63541/1980 discloses a photosensitive member comprising an undercoat layer composed of a diamond-like carbon and having a thickness of 200 Å–2 $\mu$m and an a-Si photoconductive layer formed on said udnercoat layer. This undercoat layer is formed to improve adhesion of the a-Si layer to the substrate. The undercoat layer may be so thin that a charge moves through it by tunnel effect.

As mentioned above, photosensitive members have been proposed which comprises an undercoat layer or an overcoat layer composed of an electrically insulating OPP layer, a diamond-like layer and the like, but the transport of the charge is basically attributed to the tunnel effect and the phenomena of dielectric breakdown.

The tunnel effect is caused due to the passage of electrons when the thickness of an insulating layer is thin (generally at an Angstrom unit).

Dielectric breakdown is a phenomenon in which existing small numbers of charge carriers are accelerated by an electric field to gain sufficient energy capable of ionizing atoms in the insulator, with the result that carrier ionization increases. This phenomena occurs at a high electric field (generally more than 100 V/$\mu$m).

In the case of a photosensitive member having laminated layers of an insulating layer and a semiconducting layer, charges generated in the semiconducting layer move through the layer under an electric field, but they can not pass through the insulating layer under a low electrical field. If the insulating layer is thin, it is ignored as a surface potential or it does not adversely affect properties of photosensitivity because of negligible development influence. Further, even if the charges are accumulated on the insulating layer by repeated use to give a higher potential, the potential in the electric field does not increase above a constant level (e.g. 100 V/$\mu$m) because of dielectric breakdown.

For example, when an insulating layer comprising insulating materials capable of causing dielectric breakdown at 100 V/$\mu$m is formed at a thichness of 0.1 $\mu$m, the increase of the residual potential based on the repetition is only 10 V.

According to the above reasons, it is understood that if a conventional insulating layer is used for a photosensitive member, the thickness of the layer has to be less than about 5 $\mu$m, or else the residual potential based on the insulating layer increases to more than 500 V causing an overlap of the copied image to occur.

Further, Japanese patent KOKAI No. 145540/1979 discloses introduction of carbon as a chemically modifying material into a silicon and/or germanium photoconductive layer. The carbon content is 0.1 to 30 atomic percent. Such carbon content decreases sensitivity, even though it can improve dark resistance.

As aforementioned, a conventional organic polymer layer in a photosensitive member is used as an undercoat layer or an overcoat layer, which probably requires no carrier transporting ability, and is used from the viewpoint that the layer is an insulant. Therefore, only an extremely thin layer, such as at most 5 $\mu$m, is proposed. The carriers generated in the photosensitive layer passes through the organic polymer layer by a tunnel effect. In the case that the tunnel effect cannot be expected the layer is only used so as to be so thin that the residual potential is negligible.

It has been found that the organic polymer layer, which has been considered inherently insulant, has a carrier transportability at some range of hydrogen content.

SUMMARY OF THE INVENTION

First object of the present invention is to provide a photosensitive member excellent in a transportability, sensitivity, a charge holding property and a copying property.

Second object of the present invention is to provide a photosensitive member having a charge transporting layer which facilitates the injection of charge from a charge generating layer so as to decrease residual potential and memory and increase sensitivity.

Another object of the present invention is to facilitate injection of charge from a charge generating layer so as to reduce a residual potential, to improve a sensitivity and to decrease memory when a hydrogen containing carbon layer is used as a carrier transporting layer.

These and other objects of the invention is to provide a photosensitive member which comprises;

an electrically conductive substrate;

a charge generating layer; and a charge transporting layer comprising a hydrogen-containing carbon, the hydrogen content of which is from 0.1 to 67 atomic percent based on the amount of all atoms contained in said charge transporting layer, and elements selected from the group consisting of Si, Ge and Sn at a content of less than about 10 atomic percent based on the amount of carbon and elements contained in said charge transporting layer.

DETAILED DESCRIPTION OF THE INVENTION

The present invention relates to a photosensitive member.

The present invention has been made with the new knowledge that the C:H layer acts as a carrier transporting layer when combined with a carrier generating layer and incorporation of Si, Ge and/or Sn facilitates injection of charge, decreases a residual potential and memory, and improves sensitivity.

Figure 1:
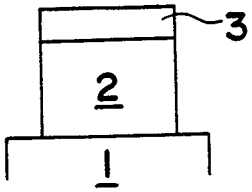
FIGS. 1–12 are schematic sectional views of photosensitive members of the present invention.

FIG. 1 shows an embodiment of a photosensitive member of the invention to illustrate the construction thereof. The photosensitive member comprises an electrically conductive substrate (1), a hydrogen-containing carbon layer (2) (referred to as the C:H layer hereinafter) which functions as a charge transporting layer and a charge generating layer (3). Said C:H layer contains hydrogen at a concentration of 0.1 to 67 atomic percent and Si, Ge, and/or Sn at a content of not more than 10 atomic percent based on all atoms contained therein.

An electrophotosensitive member requires a dark resistance of not less than $10^9$ Ω.cm and a ratio of light-/dark resistance (i.e. gain) of at least $10^2$ to $10^4$, even in a functionally separating photosensitive member.

The photosensitive member of the present invention is constituted by a carrier generating layer and a carrier transporting layer, in which said carrier transporting layer contains at least one C:H layer. Said C:H layer contains hydrogen at a content of 0.1 to 67 atomic percent based on all atoms contained therein, and Si, Ge and/or Sn at a content of not more than 10 atomic percent based on carbon and such additional elements as Si, Ge and/or Sn.

The C:H layer contains hydrogen at 0.1 to 67 atomic percent based on all atoms therein, preferably 1 to 60 atomic percent, more preferably 30 to 60 atomic percent, most preferably 40 to 58 atomic percent. The C:H layer having less than 0.1 atomic percent gives a dark resistance unsuitable for electrophotography, and more than 67 atomic percent will not give carrier transportability.

The C:H layer of the present invention can be produced as an amorphous carbon or a diamond-like carbon according to the hydrogen content or the process for production. For the most part, an amorphous C:H layer is obtained, which is soft and of high resistance to electricity. However, when the layer having a hydrogen content of less than about 40 atomic percent is produced by the plasma CVD method, a diamond-like carbon layer can be obtained. Such a layer is harder having a Vickers hardness of more than 2000 and has the resistance of more than $10^8$ Ω.cm.

Further, the C:H layer of the present invention can be produced as a polymer layer, for example, a polymer layer formed by a plasma polymerization. These polymer layers formed by plasma polymerization show excellent charge transportability when combined with charge generating layers.

Hydrogen content of the C:H layer and the structure thereof can be determined by elemental analysis, IR analysis, $^1$H-NMR, $^{13}$C-NMR and the like.

A C:H layer of the present invention has preferably an optical energy gap (Egopt) of 1.5 to 3.0 eV, and a relative dielectric constant ($\epsilon$) of 2.0 to 6.0.

The C:H layer additionally contains Si, Ge and/or Sn of not more than 10 atomic percent based on carbon and such additional elements as Si, Ge and/or Sn. The incorporation of such an element facilitates injection of charge from a charge generating layer, improves sensitivity, and decreases residual potential and memory.

In addition adhesive properties with the Al substrate as well as charge generating layer and the like are improved.

When the content of these elements exceeds 10 atomic percent, i.e. the content of carbon is less than 90 atomic percent, the following defects are caused. That is, when the carbon content is about 30 to 90 atomic percent, charge transportation efficiency decreases in spite of an increase in dark resistance. When the carbon content is 5–30 atomic percent, the charge transporting properties are improved, but the dielectric constant is dependent on the incorporated elements. For example, when Si is used, the dielectric constant is influenced by the property of Si itself, so that the object of the present invention can not be achieved. In other word the properties of the photosensitive member becomes similar to a general a-Si photosensitive member. With a carbon content of 90 to 100 atomic percent, the photosensitive member has a high sensitivity as well as excellent charge transportability and reduction of the boundary barrier between the charge generating layer and the charge transporting layer. As the relative electric constant of C:H layer is so small the charging capacity is extremely improved.

A C:H layer having a smaller Egopt (less than 1.5 eV) forms many levels near the ends of the bands, that is, at the lower end of the conduction band and the upper end of the filled band. Therefore, in this case the C:H layer is not always suitable as a charge transporting layer because of its smaller mobility of carriers and shorter carrier life. A C:H layer having a larger Egopt (more than 3.0 eV) has a tendency to make a barrier at the interface between the charge generating materials and the charge transporting materials which are ordinarily used for an electrophotosensitive member, so there are cases when the injection of carriers from the charge generating layer to the C:H layer and from the C:H layer to the charge generating layer cannot be achieved. As a result, excellent photosensitive properties cannot be obtained.

In the meanwhile, when the relative dielectric constant ($\epsilon$) is larger than 6.0, charging capacity and sensitivity decrease. Increasing the thickness of the C:H layer has been considered in order to overcome these drawbacks, but the increase in thickness of the C:H layer is not desirable for production. If the relative dielectric constant is less than 2.0, the properties of the layer become similar to those of polyethylene so as to reduce the charge transportability.

The hydrogen contained in the C:H layer (2) as a charge transporting layer may be partially substituted with halogen, for instance, fluorine, chlorine, bromine and the like. Such layers has improved water repellancy and abrasion resistance by the substitution.

The thickness of the C:H layer (2) as a charge transporting layer is preferably about 5–50 $\mu$m, especially 7–20 $\mu$m. The C:H layer having a thickness of less than 5 $\mu$m has low charging capacity, with the result that a sufficient contrast can not be obtained on a copied image. The thickness of more than 50 $\mu$m is not desirable for production. The C:H layer has an excellent light transparency, a high dark resistance and a high charge transportability. Even if the thickness of the layers exceeds 5 $\mu$m, carriers can be transported without trapping.

The C:H layers of the present invention may be produced under ionized conditions by ion vapor deposition, ion beam deposition and the like; under plasma conditions by direct current, high frequency, microwave plasma methods and the like; and through a neutral particle by reduced compression CVD, vacuum vapor deposition, sputtering methods, optical CVD and the like or a combination thereof. However, for instance, in the case that charge generating layers are produced by a high frequency plasma or CVD, it is desirable to produce C:H layers by the same method in the aspect of reduction of apparatus costs and labor saving.

Carbon sources for the C:H layers may include $C_2H_2$, $C_2H_4$, $C_2H_6$, $C_3C_6$, $CH_4$, $C_4H_{10}$, $C_4H_6$, $C_4H_8$, $C_3H_8$, $CH_3CCH$, $C_8H_8$, $C_{10}H_{16}$, and the like.

The carrier gas may preferably include $H_2$, Ar, Ne, He and the like.

In order to obtain a hydrogen-containing carbon layer having a hydrogen content of not more than 40 atomic percent in a plasma polymerization a saturated hydrocarbon diluted with hydrogen is preferably used. Examples of the most preferable hydrocarbons are methane, ethane, propane or butane. The plasma polymerization is carried out under low pressure and high voltage. Production of such a hydrogen-containing carbon layer having a low hydrogen content may be produced by an ion beam method as well as by plasma polymerization. Such a method is described in J. Appl. Phys. 52, (10) October 1981 (6151–6157). Of course, a sputtering method may be used.

As a C:H layer having a low hydrogen content is excellent in rubbing resistance and moisture resistance, a charge transporting layer comprising it may be arranged on the surface side. If arranged on the substrate side, it prevents charge from injecting into the substrate, and prevents plasma damage when a charge generating layer is formed thereon by high frequency plasma.

The C:H layer may contain hydrogen at a content of more than 40 atomic percent. Such a C:H layer having a high hydrogen content may be produced by plasma discharge or an ion beam using unsaturated hydrocarbons such as ethylene, propylene, acetylene and the like diluted with hydrogen. The pressure of the reactor for the plasma discharge is preferably higher than that for the production of a C:H layer having a low hydrogen content and the voltage is preferably lower than that of the C:H layer having a low hydrogen content.

If a C:H layer having a high hydrogen content is used as a charge transporting layer and is to be combined with an a-Si charge generating layer, a photosensitive member can be obtained, which has superior charging capacity and sensitivity as compared to a photosensitive member produced from a-Si alone. Further, such a C:H layer arranged on the substrate side acts as a charge injection preventing layer. Such a layer also improves rigidity of the surface, rubbing resistance, moisture resistance, corona resistance and adhesion.

A C:H layer having a comparably higher hydrogen content (i.e. more than 55 atomic percent) is referred to as the plasma polymerization layer (referred to as a PP C:H layer hereinafter). A PP C:H layer has a highly cross-linked net structure different from the aforementioned C:H layer. Therefore, the PP C:H layer has high density, high rigidity, high chemical resistance and heat resistance. Further, this PP C:H layer traps free radicals so as to have a higher dielectric loss than the aforementioned C:H layer. A polymerized polyethylene layer formed by plasma deposition is a typical plasma polymerization layer with ratio of a hydrogen atoms to carbon atoms of about 2.7/2, but does not have a melting point corresponding to the melting point of ordinary polyethylene, and has a heat resistance of more than 330° C.

In order to make a C:H layer containing Si, Ge and/or Sn a hydrocarbon gas such as $CH_4$, $C_2H_2$, $C_2H_4$, $C_2H_6$, $C_3H_6$, $C_3H_8$, $C_4H_8$, $C_4H_{10}$, $C_4H_6$, $CH_3CCH$ and the like is mixed with a source of the above elements such as $SiH_4$, $Si_2H_6$, $(C_2H_5)_3SiH$, $SiF_4$, $SiH_2Cl_2$, $SiCl_4$, $Si(OCH_3)_4$, $Si(OC_2H_5)_4$, $Si(OC_3H_7)_4$ and the like as a Si source; $GeH_4$, $GeCl_4$, $Ge(OC_2H_5)_4$, $Ge(C_2H_4)_4$ and the like as a Ge source, $(CH_3)_4Sn$, $(C_2H_5)_4Sn$, $SnCl_4$ and the like as a Sn source which may then be treated by frequency plasma discharge.

A thicker C:H layer is desirable for charge folding properties, but a thinner C:H layer is desirable for production and charge transportability. For ordinary electrophotography the thickness of the C:H layer is preferably 5 to 50 $\mu$m, especially 7 to 20 $\mu$m. The C:H layer has high dark resistance, and has excellent optical transmittance and charge transportability. In addition, even if the thickness is above 5 $\mu$m, the carrier can be transported without charge trapping.

According to the present invention an element belonging to IIIA group or VA group of the Periodic Table may be incorporated into C:H layers in order to control the charging properties of charge transporting layers of C:H layers.

Reverse bias effect may be achieved by making the substrate side P-type and the surface side N-type when the photosensitive member is positively charged, and by making the substrate side N-type and the surface side P-type when it is negative charged. In the above manner various effects such as improvement of the charging capacity, decrease of the reduction rate of the surface potential in darkness and improvement of the sensitivity of a photosensitive member, can be obtained. In a photosensitive member constituted by laminating C:H charge transporting layers and charge generating layers, elements of VA group or IIIA group may be incorporated into the charge transporting layer or, if desired, into the charge generating layer such that when positive charge the surface side becomes comparatively N-type and the substrate side becomes comparatively P-type whenever the carrier generating layer is arranged on the surface side and the charge transporting layer is on the substrate side or vice versa.

Polarity may be controlled by gradually increasing the amount of an element of IIIA or VA group on the surface side or the substrate side within a layer, or by a single charge transporting C:H layer containing an element of IIIA or VA group may be arranged on the surface side or the substrate side. Alternatively, if necessary, plural C:H layers with different concentrations of elements of the IIIA or VA groups may be arranged at conjunction areas so as to form depletion layers.

With respect to FIG. 1, if the photosensitive member of FIG. 1 is positively charged and then exposed to a light image, charge carriers are generated in the charge generating layer (3). The electrons neutralize the surface charge. The holes are transported to the substrate (1) by the excellent charge transportability of the C:H layer (2). As aforementioned, the C:H charge transporting layer (2) is improved by the addition of any one of Si, Ge, Sn, or two or more thereof, at a content of not more than 10 atomic percent. When an a-Si charge generating layer, without any polarity control, is used with a positive charge, the C:H charge transporting layer is preferably controlled to be a P-type. Since a-Si itself is of weak N-type or intrinsic, it has a tendency to control the injection of positive charge from the surface, and a C:H charge transporting layer controlled to be a P-type facilitates the movement of holes.

Elements of the IIIA group used to form a P-type may include B, Al, Ga, In and the like, especially B. The surface layer may be controlled to be a relatively higher N-type by incorporating elements of the VA group, such as P, into the a-Si charge generating layer. In this case the C:H layer may be controlled to be a P-type. When the photosensitive members are used at negative charge, the C:H layer (2) is controlled to be a N-type by incorporating P therein. When a-Si is used as a carrier generating layer, B may be incorporated.

FIGS. 2 to 12 show other embodiments of photosensitive members according to the invention to illustrate the construction thereof.

Figure 2:
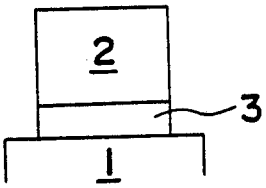

FIG. 2 illustrates a photosensitive member containing a C:H layer as the outmost layer. When this member has a positive charge, the polarity of the C:H layer (2) may be controlled to be a N-type in comparison with the charge generating layer (3) by an element of the VA group so as to facilitate mobility of electrons. When the photosensitive member is used with a negative polarity, the C:H layer may be inversely controlled by incorporating B, for example.

The photosensitive member of FIG. (3) is an embodiment containing a C:H layer (2) on the upper and lower sides of the charge generating layer (3). When it is used at a positive polarity, it is desirable to control the upper C:H layer (2) to be a N-type in comparison with the charge generating layer (3) so as to facilitate mobility of electrons, whereas the lower C:H layer (2) is controlled to be a P-type.

Figure 3:
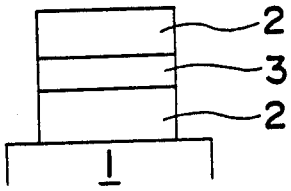
Figure 4:
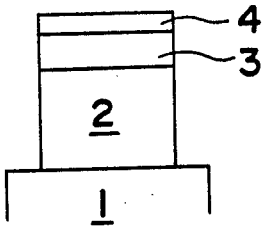
Figure 5:
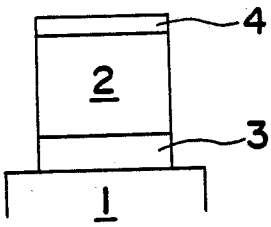
Figure 6:
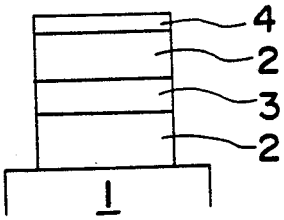

Photosensitive members illustrated in FIGS. 4–6 have an overcoat layer (4) on photosensitive members of FIGS. 1–3. The overcoat layers act as a surface protective layer for a charge generating layer (3) or a C:H charge transporting layer (2), and improve the initial surface potential. The thickness of the overcoat layer is preferably about 0.01–5 μm. As a surface protective layer, any materials which are usually used therefor may be used. In the present invention the protective layer is preferably formed by organic plasma polymerization for production reasons. The overcoat layer may be the C:H layer of the present invention. Elements of the IIIA or VA groups may be doped into the surface protective layer (4), if necessary.

Figure 7:
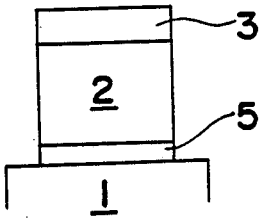
Figure 8:
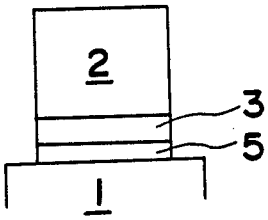
Figure 9:
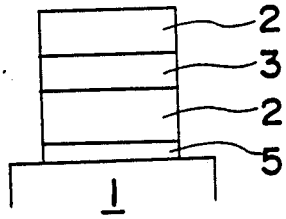
Figure 10:
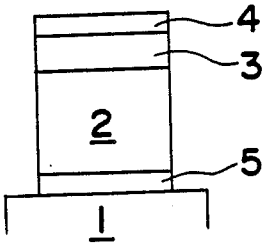
Figure 11:
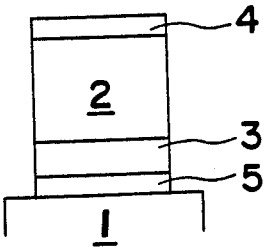
Figure 12:
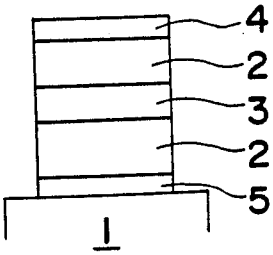

Photosensitive members of FIGS. 7–9 are examples in which a C:H layer used as a carrier transporting layer is applied to the substrate (1) to make it function as an undercoat layer, a barrier layer and/or an adhesive layer. As an undercoat layer, of course, conventional materials may be used. In such a case the undercoat layer may be preferably formed by organic plasma polymerization. The barrier layer inhibits injection of charge from the substrate and transports charges generated in the charge generating layer (3) to the substrate. Therefore, it is desirable to incorporate elements of IIIA group when the charge generating layer is used with a positive polarity and elements of VA group when it is used with a negative polarity. The thickness of the barrier layer is preferably about 0.01–5 μm. An overcoat layer (4) may be applied on photosensitive members of FIGS. 7–9 as illustrated in FIGS. 10–12.

In order to incorporate elements of group IIIA into the C:H layer suitable gaseous compounds containing these elements are deposited with hydrocarbon gas under an ionized state or a plasma state. Alternatively, the C:H layer may be exposed to gas containing elements of group IIIA to be doped.

Compounds containing boron may include $B(OC_2H_5)_3$, $B_2H_6$, $BCl_3$, $BBr_3$, $BF_3$ and the like.

Compounds containing aluminum may include $Al(Oi—C_3H_7)_3$, $(CH_3)_3Al$, $(C_2H_5)_3AL$, $(i—C_4H_8)_3Al$, $AlCl_3$ and the like.

Compounds containing gallium may include $Ga(Oi—C_3H_7)_3$, $(CH_3)_3Ga$, $(C_2H_5)_3Ga$, $GaCl_3$, $GaBr_3$ and the like.

Compounds containing indium may include $In(Oi—C_3H_7)_3$, $(C_2H_5)_3In$ and the like.

The content of elements of IIIA group may be preferably not more than 20,000 ppm, more preferably about 3–1000 ppm.

Elements of the VA group used for polarity control may be P, As, and Sb, especially P. The elements of VA group may be incorporated into the C:H layers in the same manner as the IIIA group.

Compounds containing elements of the VA group, useable in the present invention, may include $PO(OCH_3)_3$, $(C_2H_5)_3P$, $PH_3$, $POCl_3$ and the like as a compound containing P; $AsH_3$, $AsCl_3$, $AsBr_3$ and the like as a compound containing As; $Sb(OC_2H_5)_3$, $SbCl_3$, $SbH_3$ and the like as a compound containing Sb.

The content of the elements of VA groups is preferably not more than 20,000 ppm, more preferably about 1-1000 ppm.

The properties of charge generating layer of the photosensitive members may be controlled by incorporating additional elements.

There are cases when the charge transporting layers are colored to, for instance, yellow, blue, brown or so according to a production condition or by impurity contamination. In the embodiments of FIGS. 2, 3, 4, 5, 6, 8, 9, 10, 11 and 12 such a phenomena may be utilized to prevent injurious light transmitting to the charge generating layers.

Nitrogen, oxygen, sulfur and/or various kinds of metals may be additionally incorporated into C:H charge generating layers, or a part of hydrogen of the C:H layer may be substituted with halogen.

As a nitrogen source $N_2$, $NH_3$, $N_2O$, NO, $NO_2$, $C_2H_5NH_2$, HCN, $(CH_3)_3N$, $CH_3NH_2$ and the like may be used in general, and addition thereof can make the phase boundary barrier smaller between charge generating layers and charge transporting layers.

As an oxygen source $O_2$, $O_3$, $N_2O$, NO, CO, $CO_2$, $CH_3OCH_3$, $CH_3CHO$ and the like are exemplified. The incorporation of these compounds improves charging capacity, and can accelerate the plasma CVD layer formation rate.

As a sulfur source $CS_2$, $(C_2H_5)_2S$, $H_2S$, $SF_6$, $SO_2$ and the like are exemplified. The incorporation of sulfur is effective for the prevention of light absorption and light interference. In addition, the rate of layer formation can be made faster by sulfur doping.

Metals which may be incorporated include the following:

Ba: $Ba(OC_2H_5)_3$; Ca: $Ca(OC_2H_5)_3$; Fe: $Fe(Oi—C_3H_7)_3$, $(C_2H_5)_2Fe$, $Fe(CO)_5$; Hf; $Hf(Oi—C_3H_7)$; K: $KOi—C_3H_7$; Li: $LiOi—C_3H_7$; La: $La(Oi—C_3H_7)_4$; Mg: $Mg(OC_2H_5)_2$, $(C_2H_5)_2Mg$; Na: $NaOI—C_3H_7$; Sb: $Sb(OC_2H_5)_2$, $SbCl_3$, $SbH_3$; Nb: $Nb(OC_2H_5)_5$; Sr: $Sr(OCH_3)_2$; Ti: $Ti(Oi—C_3H_7)_4$, $Ti(OC_4H_9)_4$, $TiCl_4$; Ta: $Ta(OC_2H_5)_5$; V: $VO(OC_2H_5)_3$, $VO(OtC_4H_9)_3$; Y: $Y(Oi—C_3H_7)_3$; Zn: $Zn(OC_2H_5)_2$, $(CH_3)_2Zn$, $(C_2H_5)_2Zn$; Zr: $Zr(Oi—C_3H_7)_4$; Cd: $(CH_3)_2Cd$; Co; $Co(CO)_8$, Cr: $Cr(CO)_6$; Mn: $Mn_2(CO)_{10}$; Mo: $Mo(CO)_6$, $MoF_6$, $MoCl_6$; W: $W(CO)_6$, $WF_6$, $WCl_6$; Te: $H_2Te$; Se: $H_2Se$.

By the substitution of hydrogen with halogen in the C:H layer water repellance, rubbing resistance and light transmittance can be improved. Especially when the substitution is of fluorine —CF, $—CF_2$, $—CF_3$, and the like the refractive index (n) becomes smaller (eg. 1.39) so that reflection also becomes smaller.

If the C:H layer obtained according to the present invention is contacted with the atmosphere after argon treatment carbonyl groups are formed on the surface of the layer to be activated. The group of $—CF_2$ is changed to —CF.

As a source of carbon and halogen $C_2H_5Cl$, $C_2H_3Cl$, $CH_3Cl$, $CH_3Br$, $COCl_2$, $CCl_2F_2$, $CHClF_2$, $CF_4$, HCl, $Cl_2$, $F_2$ and the like may be used.

Charge generating layers which may be used in the present invention are not restrictive. Any charge generating layers may be used. Examples of these layers may be a-Si layers which may contain various kinds of element to change the properties of the layers such as C, O, S, N, P, B, Ge, halogen and the like, and may be of multilayer structures; Se layers; Se-As layers; Se-Te layers; CdS layers; layers made by binding inorganic or organic charge generating compounds with resinous materials; and the like. Such inorganic compounds may include zinc oxide and the like, and such organic compounds may include bis-azo compounds, triarylmethane dye, thiazine dye, oxazine dye, xanthene dye, cyanine dye, styryl dye, pyryliums, azo compounds, quinacridones, indigos, perillenes, polycyclic quinones, bisbezimidazoles, Indanthrenes, squaliliums, phthalocyanines and the like.

Other compounds, so far as these can absorb light to generate carriers at a high efficiency, can be used. Charge generating layers may be formed by any method.

The charge generating layers of the present invention may be arranged anywhere as described before, such as an outmost layer, an innermost layer or a middle layer. The thickness of charge generating layers may be designed such that 90% of 555 nm light can generally be absorbed, which is depended on the kind of materials, especially spectrophotoabsorption properties, sources of light exposure, objects and the like. In the case of a-Si:H, the thickness of the layer is generally about 0.1-1 μm.

The photosensitive member of the present invention contains carrier generating layers and carrier transporting layers. Therefore, there are at least two processes needed to produce the member. When a-Si layers are formed using, for example, an apparatus for glow discharge decomposition, plasma polymerization can be carried out in the same apparatus. Therefore, C:H charge transporting layers, surface protective layers, barrier layers and the like are preferably produced by the plasma polymerization.

Figure 13:
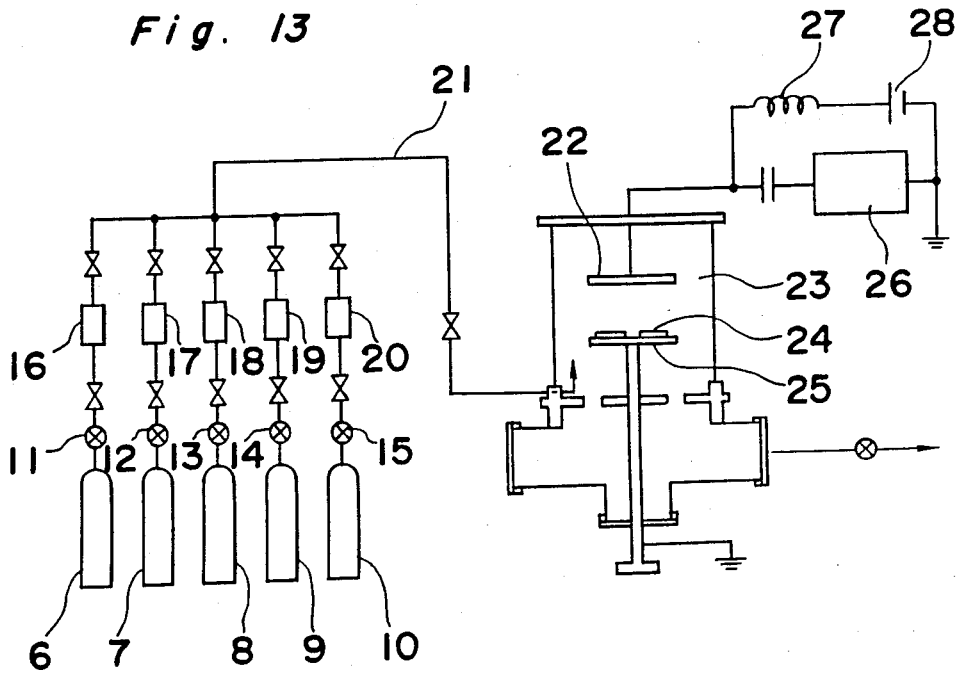
FIGS. 13–15 are examples of apparatus for production of photosensitive member of the present invention.
Figure 14:
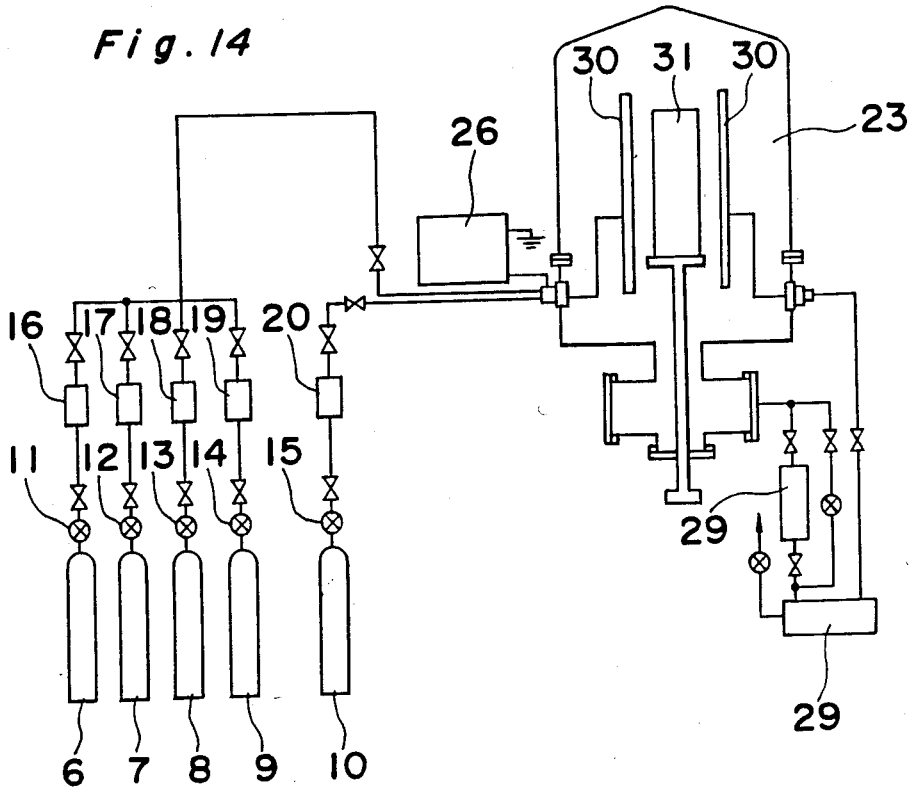

FIGS. 13 and 14 illustrate a capacitive coupling type plasma CVD apparatus for the production of the photosensitive member of the present invention. FIG. 13 shows a parallel plate type plasma CVD apparatus, and FIG. 14 shows a tubular plasma CVD apparatus. Both apparatuses are different in that electrodes (22) and (25) and the substrate (24) of FIG. 13 are plates, but in FIG. 14 the electrode (30) and the substrate (31) are tubular. In the present invention, of course, a photosensitive member can be produced by an induction coupling type plasma CVD apparatus.

Production of the photosensitive member of the present invention is illustrated according to the parallel plate type plasma CVD apparatus (FIG. 13). In FIG. 13, (6)-(10) show the 1st to 5th tanks for $C_2H_4$, $H_2$, $B_2H_6$, $SiH_4$ and $GeO_2$ gases respectively, each of which is connected to the 1st to 5th control valves (11)-(15) and the 1st to 5th mass flow controllers (16) to (20) respectively. These gases are sent to a reactor (23) through a main pipe (21).

In the reactor (23) a grounded electrode plate (25), on which the electroconductive substrate such as an Al plate (24) is arranged, is electrically connected with the plate-like electrode (22) which is connected with a high frequency current source (26), facing each other through the condenser. The electrode (22) is connected with a direct current source (28) through a coil (27) in such a manner that a bias is applied in addition to electric power from the frequency current source (26). The electroconductive substrate (24), set on the electrode (25), is arranged such that it can be heated to, for example, 350° C. by a heating means (not illustrated).

When a photosensitive member illustrated in FIG. 1, for example, is prepared with $C_2H_4$ gas, $H_2$ gas as a carrier gas, the gases and $SiH_4$ gas may be supplied from the first tank (6), the second tank (7) and 4th tank (9)

respectively through the main pipe (21) after the reactor is maintained at a constant vacuum. Then an electric power of 0.03–1 kw is applied from the frequency current source (26) to the electrode (22) to cause plasma discharge between both electrodes to form a C:H charge transporting layer (2) containing Si at less than 10 atomic percent and having a thickness of 5 to 50 μm thick on a preheated substrate (24). The hydrogen content of the C:H charge transporting layer is dependent on production conditions such as the kinds of starting materials, the ratio of the material and the diluting gas ($H_2$ gas or inert gas such as He), discharging power, pressure, substrate temperature, DC bias, anneal temperature, and frequency at discharge. The hydrogen content can be controlled by varying the bias from 0.05 to 1 kv. That is, the hydrogen content can be reduced by applying a higher bias so as to increase the hardness of the C:H layer. The C:H charge transporting layer obtained has excellent light transmittance, a dark resistance and carrier transportability. The layer may be controlled to be a P type by the introduction of $B_2H_6$ gas from the 3rd tank (8) to improve the charge transportability still more. If $PH_3$ gas is used instead of $B_2H_6$, the layer can be controlled to be a N type.

As a charge generating layer (3) a layer mainly made of a-Si may be applied by introduction of $H_2$ gas and $SiH_4$ from the 2nd tank (7) and the 4th tank (9) respectively.

The egopt is dependent on the kind of starting gaseous materials, the ratio of the starting materials and the diluting gas ($H_2$ and inert gas etc.), charging power, pressure, substrate temperature, DC bias, anneal temperature, discharging frequency and the like. Discharging power, substrate temperature and anneal temperature especially affect the Egopt.

The egopt of the present invention can be calculated from the absorption edge by the formula of $\sqrt{\alpha h\nu - h\nu}$ wherein $\alpha$ represents the absorption coefficient and $h\nu$ representes light energy.

The dielectric constant of the C:H layer is dependent on the kind of stating gaseous material, the DC bias generated by discharge or applied from outside, the discharging power and the like, and can be controlled by changing them.

Figure 15:
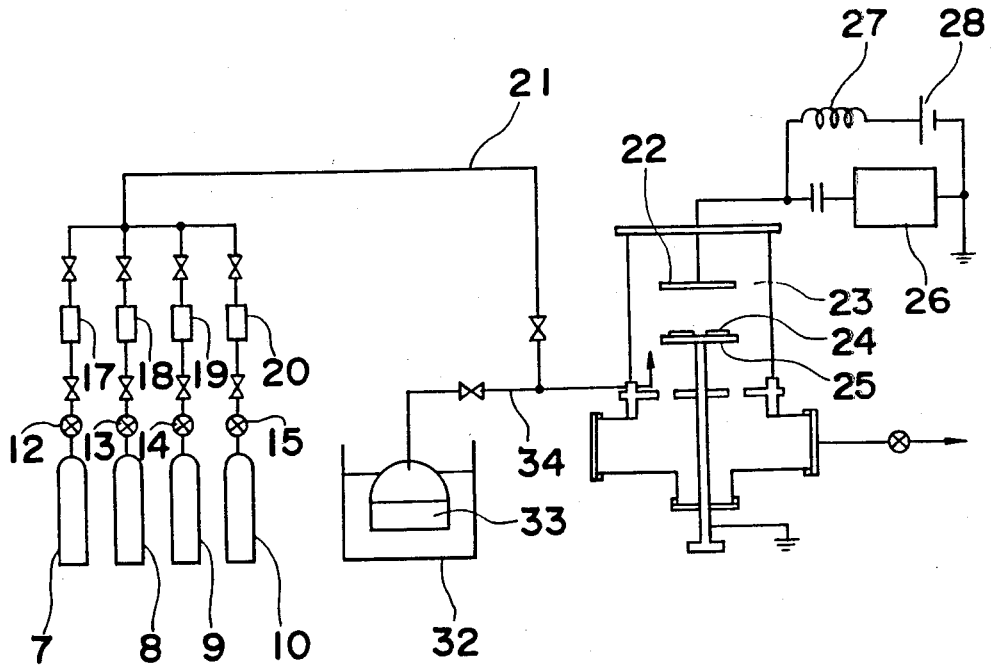
Figure 16:
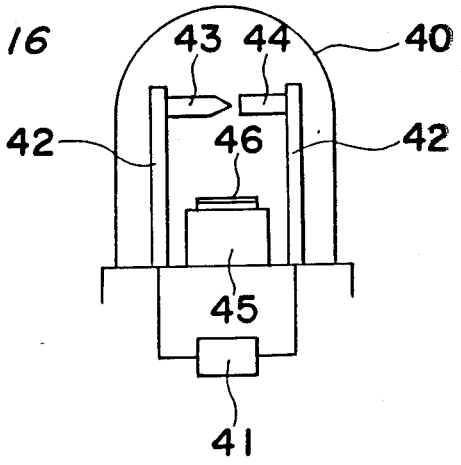
FIG. 16 shows an apparatus for arc deposition used in a comparative example.

A capacitance coupling CVD apparatus as shown in FIG. 15 illustrates an embodiment using a monomer such as $C_8H_8$ as a source of the C:H layer, in which a monomer (33) in a constant temperature bath (32), as well as the pipe (34) connected to the reactor, is heated for introduction into the reactor (23) as a vapor. The other constitutions are the same as FIG. 13.

The photosensitive member of the present invention has excellent charge transportance and charging capacity, and a sufficient surface potential can be obtained even when the thickness of the C:H layer is thin.

The production costs are low, and the production time is short, because the raw material costs are low, every layer can be formed in the same reactor, and the layers may be thin. Even a thin C:H layer can be produced without pin holes. If the C:H layer of the present invention is used as an outmost surface, durability of the photosensitive member is improved because of its excellent resistance to corona, acids, moisture, heat and rigidity.

The present invention is illustrated by the following examples, but it should not be construed restrictively to them.

EXAMPLE 1

(I) Formation of C:H charge transporting layer

In the glow discharge decomposition apparatus shown in FIG. 13, the reactor (23) is evacuated to a high vacuum of about $10^{-6}$ Torr, and then the 1st, 2nd and 4th controlling valves (11), (12) and (14) were opened to send $C_2H_4$ gas from the 1st tank (6), $H_2$ gas from the 2nd tank (7) and $SiH_4$ gas from the 4th tank (9) to mass flow controllers (16), (17) and (19) respectively under an output gauge of 1 $Kg/cm^2$. Thereafter, the flow rate of $C_2H_4$, $H_2$ and $SiH_4$ gases were set on 60 sccm, 80 sccm and 0.2 sccm respectively by adjusting the scales of the respective mass flow controllers, and the gases were sent to the reactor (23). After the flow rate of every gas was stabilized, the inner pressure of the reactor was adjusted to 1.2 Torr. Separately, the aluminum plate of 3×50×50 mm, an electroconductive substrate (24), was preheated to 250° C. When both the flow rate of the gases and the inner pressure were stabilized, a high-frequency power of 100 watts (frequency, 13.56 MHz) was applied to the electrode (22) from the power source (26) to continue plasma polymerization for 5 hours to form the C:H charge transporting layer of about 5 μm thick (Si content (Si/(C+Si)): 2 atomic %) on the substrate (24).

(II) Formation of a-Si charge generating layer

The application of power from the high frequency power source (26) was temporarily stopped, and the reactor was evacuated.

Thereafter, $SiH_4$ gas (100%) from the 4th tank (9), $B_2H_6$ gas (diluted to 1 ppm by $H_2$ gas) from 3rd tank (8) and $N_2O$ gas (the tank is not shown) were sent at a flow rate of 90 sccm, 210 sccm and 1 sccm, and then the inner pressure of the reactor (23) was adjusted to 1.0 Torr.

When the flow rate and the inner pressure were stabilized, a high frequency power (frequency, 13.56 MHz) of 20 watts was applied to the substrate with the C:H charge transporting layer from the electrode (22) to generate glow discharge. This glow discharge was continued for 20 minutes to form a 1 μm thick a-Si charge generating layer.

The photosensitive member obtained had an initial surface charge (Vo) of 340 V, an exposure for half reduction of surface potential ($E_{\frac{1}{2}}$) of 3.6 lux.sec. When this photosensitive member was held for 72 hours under the condition of 30° C. and 85% RH, an exfoliation from the substrate was not observed. A clear copy was obtained from this photosensitive member.

The properties of the above photosensitive member, i.e. the initial surface potential, and the exposure amount for half reduction of surface potential and residual potential are evaluated in the following table as excellent (o), good (Δ), unacceptable (x), so the excellence of the invention can be understood.

| | evaluation | | |
|---|---|---|---|
| properties | O | Δ | X |
| $V_0$ (V)/member thickness (μm) | 70–40 | 40–10 | 10–0 |
| $E_{\frac{1}{2}}$ (lux.sec) | 1.9–3.6 | 3.7–6.9 | 7.0– |
| $V_r/V_0$ (%) | 0–25 | 25–50 | 50–100 |

EXAMPLES 2–17, 19–23 AND 25–29

Photosensitive members were prepared according to Example 1 with some modifications as shown in Tables 2–17, 19–23 and 25–29. The results are shown in the above Tables.

EXAMPLE 18

| Formulation | parts by weight |
|---|---|
| styrene | 200 |
| methyl methacrylate | 160 |
| n-butyl acrylate | 75 |
| β-hydroxypropyl acrylate | 55 |
| maleic acid | 8 |
| benzoyl peroxide | 7.5 |
| ethylene glycol monomethyl ether | 150 |

The mixture obtained from the above formulation was added dropwise to a reaction vessel containing xylene (350 parts by weight) with stirring under nitrogen atmosphere at 105° C. for 2 hours to react. After 2.5 hours elapsed since the initiation of the polymerization an additional benzoyl peroxide (0.5 part by weight) was added to react for 8 hours as stirring under heating to give a thermoset hydroxyl-containing acrylic resin (viscosity: 800 cps, solid: 50%).

The thermoset hydroxyl-containing acrylic resin (34 parts by weight), melamine resin (Super Beckamine J 820; available from Dainippon Ink & Chemicals Inc.) (6 parts by weight), 2,4,5,7-tetranitro-9-fluorenone (0.5 parts by weight), epsilon-copper phthalocyanine available from Toyo Ink Co., Ltd. (20 parts by weight), cellosolve acetate (40 parts by weight) and methyl ethyl ketone (40 parts by weight) were blended in a ball mill pot for 30 hours to give a photoelectroconductive paint. The obtained paint was coated on the surface of a C:H charge transporting layer shown in Table 18, dried and then cured to give a photosensitive member for electrophotography. The member had an electrophotoconductive layer of 1 μm in thickness.

The results are shown in Table 18.

EXAMPLES 24 AND 30

Photosensitive members are prepared according to the Example 1 with some modifications as shown in Tables 24 and 30. The results are shown in the above Tables.

COMPARATIVE EXAMPLES 1–9

Photosensitive members having a charge transporting layer are prepared according to Example 1 with some modification as shown in Tables 31–39. The transporting layer of the photosensitive member contains 0 atm. % or more than 10 atm. % of Si, Ge or Sn. The results are shown in Tables 31–39.

TABLE 1

| | CTL(1) | CGL(2) |
|---|---|---|
| $C_2H_4$ (sccm) | 60 | |
| $H_2$ (sccm) | 80 | |
| $GeH_4$ (sccm) | | |
| $SiH_4$ (sccm) | 0.2 | 90 |
| $N_2O$ (sccm) | | 1 |
| $H_2 + B_2H_6$ (sccm) | | 210 ($B_2H_6$/$SiH_4$ = 1 ppm) |
| Power (W) | 100 | 20 |
| inner pressure of reactor (Torr) | 1.2 | 1.0 |
| time | 5 (hour) | 20 (minute) |
| thickness of layer (μm) | 5 | 1 |
| Si content (atomic %) = $\frac{Si}{C + Si}$ | 2 | — |
| hydrogen content (atomic %) | 50 | — |
| $V_0$ (V) | +340 | |
| $E_{\frac{1}{2}}$ (lux.sec) | 3.6 | |
| adhesivity to substrate | Δ | |
| adhesivity to CGL | o | |
| residual potential Vr (V) | o | |

(1)charge transporting layer (abbreviated to CTL hereinafter)
(2)charge generating layer (abbreviated to CGL hereinafter)

TABLE 2

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | 0.6 | 90 |
| $N_2O$ (sccm) | | 1 |
| $H_2 + B_2H_6$ (sccm) | | 210 ($B_2H_6$/$SiH_4$ = 1 ppm) |
| Power (W) | 100 | 20 |
| inner pressure of reactor (Torr) | 1.2 | 1.0 |
| time | 5 (hour) | 20 (minute) |
| thickness of layer (μm) | 5 | 1 |
| Si content (atomic %) = $\frac{Si}{C + Si}$ | 5 | — |
| hydrogen content (atomic %) | 50 | — |
| $V_0$ (V) | +350 | |
| $E_{\frac{1}{2}}$ (lux.sec) | 2.3 | |
| adhesivity to substrate | o | |
| adhesivity to CGL | o | |
| residual potential Vr (V) | o | |

TABLE 3

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | 1 | 90 |
| $N_2O$ (sccm) | | 1 |
| $H_2 + B_2H_6$ (sccm) | | 210 ($B_2H_6$/$SiH_4$ = 1 ppm) |
| Power (W) | 100 | 20 |
| inner pressure of reactor (Torr) | 1.2 | 1.0 |
| time | 5 (hour) | 20 (minute) |
| thickness of layer (μm) | 5 | 1 |
| Si content (atomic %) = $\frac{Si}{C + Si}$ | 7 | — |
| hydrogen content (atomic %) | 50 | — |
| $V_0$ (V) | +340 | |
| $E_{\frac{1}{2}}$ (lux.sec) | 3.6 | |
| adhesivity to substrate | o | |
| adhesivity to CGL | o | |
| residual potential Vr (V) | o | |

TABLE 4

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | 2 | 90 |
| $N_2O$ (sccm) | | 1 |
| $H_2 + B_2H_6$ (sccm) | | 210 ($B_2H_6$/ $SiH_4$ = 1 ppm) |
| Power (W) | 100 | 20 |
| inner pressure of reactor (Torr) | 1.2 | 1.0 |
| time | 5 (hour) | 20 (minute) |
| thickness of layer (μm) | 5 | 1 |
| Si content (atomic %) = $\frac{Si}{C + Si}$ | 10 | — |
| hydrogen content (atomic %) | 50 | — |
| $V_0$ (V) | | +350 |
| $E_{\frac{1}{2}}$ (lux.sec) | | 5.5 |
| adhesivity to substrate | | o |
| adhesivity to CGL | | o |
| residual potential Vr (V) | | Δ |

TABLE 5

| | CTL | CGL |
|---|---|---|
| $C_2H_4$ (sccm) | 60 | |
| $H_2$ (sccm) | 80 | |
| $GeH_4$ (sccm) | 0.5 | |
| $SiH_4$ (sccm) | | 90 |
| $N_2O$ (sccm) | | 1 |
| $H_2 + B_2H_6$ (sccm) | | 210 ($B_2H_6$/ $SiH_4$ = 1 ppm) |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Ge content (atomic %) = $\frac{Ge}{C + Ge}$ | 2 | — |
| hydrogen content (atomic %) | 50 | — |
| $V_0$ (V) | | +580 |
| $E_{\frac{1}{2}}$ (lux.sec) | | 2.9 |
| adhesivity to substrate | | o |
| adhesivity to CGL | | o |
| residual potential Vr (V) | | o |

TABLE 6

| | CTL | CGL |
|---|---|---|
| $C_2H_4$ (sccm) | 60 | |
| $H_2$ (sccm) | 80 | |
| $GeH_4$ (sccm) | 1 | |
| $SiH_4$ (sccm) | | 90 |
| $N_2O$ (sccm) | | 1 |
| $H_2 + B_2H_6$ (sccm) | | 210 ($B_2H_6$/ $SiH_4$ = 1 ppm) |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Ge content (atomic %) = $\frac{Ge}{C + Ge}$ | 4 | — |
| hydrogen content (atomic %) | 50 | — |
| $V_0$ (V) | | +580 |
| $E_{\frac{1}{2}}$ (lux.sec) | | 2.3 |

TABLE 6-continued

| | CTL | CGL |
|---|---|---|
| adhesivity to substrate | | o |
| adhesivity to CGL | | o |
| residual potential Vr (V) | | o |

TABLE 7

| | CTL | CGL |
|---|---|---|
| $C_2H_4$ (sccm) | 60 | |
| $H_2$ (sccm) | 80 | |
| $GeH_4$ (sccm) | 1.5 | |
| $SiH_4$ (sccm) | | 90 |
| $N_2O$ (sccm) | | 1 |
| $H_2 + B_2H_6$ (sccm) | | 210 ($B_2H_6$/ $SiH_4$ = 1 ppm) |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Ge content (atomic %) = $\frac{Ge}{C + Ge}$ | 6 | — |
| hydrogen content (atomic %) | 50 | — |
| $V_0$ (V) | | +480 |
| $E_{\frac{1}{2}}$ (lux.sec) | | 2.9 |
| adhesivity to substrate | | o |
| adhesivity to CGL | | o |
| residual potential Vr (V) | | o |

TABLE 8

| | CTL | CGL |
|---|---|---|
| $C_2H_4$ (sccm) | 60 | |
| $H_2$ (sccm) | 80 | |
| $GeH_4$ (sccm) | 2.0 | |
| $SiH_4$ (sccm) | | 90 |
| $N_2O$ (sccm) | | 1 |
| $H_2 + B_2H_6$ (sccm) | | 210 ($B_2H_6$/ $SiH_4$ = 1 ppm) |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Ge content (atomic %) = $\frac{Ge}{C + Ge}$ | 8 | — |
| hydrogen content (atomic %) | 50 | — |
| $V_0$ (V) | | +400 |
| $E_{\frac{1}{2}}$ (lux.sec) | | 3.6 |
| adhesivity to substrate | | o |
| adhesivity to CGL | | o |
| residual potential Vr (V) | | o |

TABLE 9

| | CTL | CGL |
|---|---|---|
| $C_2H_4$ (sccm) | 60 | |
| $H_2$ (sccm) | 80 | |
| $GeH_4$ (sccm) | 2.5 | |
| $SiH_4$ (sccm) | | 90 |
| $N_2O$ (sccm) | | 1 |
| $H_2 + B_2H_6$ (sccm) | | 210 ($B_2H_6$/ $SiH_4$ = 1 ppm) |
| Power (W) | 100 | 20 |
| inner pressure of | 1.2 | 1.0 |

TABLE 9-continued

| | CTL | CGL |
|---|---|---|
| reactor (Torr) | | |
| time | 10 (hour) | 20 (minute) |
| thickness of layer (μm) | 10 | 1 |
| Ge content (atomic %) = $\frac{Ge}{C + Ge}$ | 10 | — |
| hydrogen content (atomic %) | 50 | — |
| $V_0$ (V) | +200 | |
| $E_{\frac{1}{2}}$ (lux.sec) | 5.5 | |
| adhesivity to substrate | o | |
| adhesivity to CGL | o | |
| residual potential Vr (V) | o | |

TABLE 10

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | | 90 |
| $N_2O$ (sccm) | | 1 |
| $H_2 + B_2H_6$ (sccm) | | 210 ($B_2H_6$/$SiH_4$ = 1 ppm) |
| $S_n(CH_3)_4$ | 0.3 | |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Sn content (atomic %) = $\frac{Sn}{C + Sn}$ | 2 | — |
| hydrogen content (atomic %) | 50 | — |
| $V_0$ (V) | +580 | |
| $E_{\frac{1}{2}}$ (lux.sec) | 2.9 | |
| adhesivity to substrate | o | |
| adhesivity to CGL | o | |
| residual potential Vr (V) | o | |

TABLE 11

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | | 90 |
| $N_2O$ (sccm) | | 1 |
| $H_2 + B_2H_6$ (sccm) | | 210 ($B_2H_6$/$SiH_4$ = 1 ppm) |
| $S_n(CH_3)_4$ | 0.8 | |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Sn content (atomic %) = $\frac{Sn}{C + Sn}$ | 5 | — |
| hydrogen content (atomic %) | 50 | — |
| $V_0$ (V) | +580 | |
| $E_{\frac{1}{2}}$ (lux.sec) | 2.3 | |
| adhesivity to substrate | o | |
| adhesivity to CGL | o | |
| residual potential Vr (V) | o | |

TABLE 12

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | | 90 |
| $N_2O$ (sccm) | | 1 |
| $H_2 + B_2H_6$ (sccm) | | 210 ($B_2H_6$/$SiH_4$ = 1 ppm) |
| $S_n(CH_3)_4$ | 1.1 | |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Sn content (atomic %) = $\frac{Sn}{C + Sn}$ | 7 | — |
| hydrogen content (atomic %) | 50 | — |
| $V_0$ (V) | +440 | |
| $E_{\frac{1}{2}}$ (lux.sec) | 3.6 | |
| adhesivity to substrate | o | |
| adhesivity to CGL | o | |
| residual potential Vr (V) | o | |

TABLE 13

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | | 90 |
| $N_2O$ (sccm) | | 1 |
| $H_2 + B_2H_6$ (sccm) | | 210 ($B_2H_6$/$SiH_4$ = 1 ppm) |
| $S_n(CH_3)_4$ | 1.5 | |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Sn content (atomic %) = $\frac{Sn}{C + Sn}$ | 10 | — |
| hydrogen content (atomic %) | 50 | — |
| $V_0$ (V) | +200 | |
| $E_{\frac{1}{2}}$ (lux.sec) | 5.5 | |
| adhesivity to substrate | o | |
| adhesivity to CGL | o | |
| residual potential Vr (V) | o | |

TABLE 14

| | CTL | CGL |
|---|---|---|
| $C_2H_4$ (sccm) | 240 | |
| $H_2$ (sccm) | 320 | 210 |
| $GeH_4$ (sccm) | | |
| $SiH_4$ (sccm) | 24 | 90 |
| $N_2O$ (sccm) | | 1 |
| $H_2 + B_2H_6$ (sccm) | | |
| Power (W) | 800 | 10 |
| inner pressure of reactor (Torr) | 0.5 | 1.0 |
| time | 8 (hour) | 40 (minute) |
| thickness of layer (μm) | 17 | 0.5 |
| Si content (atomic %) = $\frac{Si}{C + Si}$ | 5 | — |
| hydrogen content (atomic %) | 30 | — |

TABLE 14-continued

| | CTL | CGL |
|---|---|---|
| $V_0$ (V) | −400 | |
| $E_{\frac{1}{2}}$ (lux · sec) | 5.3 | |
| adhesivity to substrate | o | |
| adhesivity to CGL | o | |
| residual potential Vr (V) | o | |

TABLE 15

| | CTL | CGL |
|---|---|---|
| $C_2H_4$ (sccm) | 180 | |
| $H_2$ (sccm) | 240 | 210 |
| $GeH_4$ (sccm) | | |
| $SiH_4$ (sccm) | 18 | 90 |
| $N_2O$ (sccm) | | 1 |
| $H_2 + B_2H_6$ (sccm) | | |
| Power (W) | 600 | 10 |
| inner pressure of reactor (Torr) | | 1.0 |
| time | 8 (hour) | 40 (minute) |
| thickness of layer (μm) | 16 | 0.5 |
| Si content (atomic %) $= \frac{Si}{C + Si}$ | 5 | — |
| hydrogen content (atomic %) | 37 | — |
| $V_0$ (V) | −460 | |
| $E_{\frac{1}{2}}$ (lux · sec) | 4.5 | |
| adhesivity to substrate | o | |
| adhesivity to CGL | o | |
| residual potential Vr (V) | o | |

TABLE 16

| | CTL | CGL |
|---|---|---|
| $i\text{-}C_4H_{10}$ (sccm) | 180 | |
| $H_2$ (sccm) | 120 | 210 |
| $GeH_4$ (sccm) | | |
| $SiH_4$ (sccm) | 36 | 90 |
| $N_2O$ (sccm) | | 1 |
| $H_2 + B_2H_6$ (sccm) | | |
| Power (W) | 500 | 10 |
| inner pressure of reactor (Torr) | 0.5 | 1.0 |
| time | 8 (hour) | 40 (minute) |
| thickness of layer (μm) | 10 | 0.5 |
| Si content (atomic %) $= \frac{Si}{C + Si}$ | 5 | — |
| hydrogen content (atomic %) | 45 | — |
| $V_0$ (V) | −340 | |
| $E_{\frac{1}{2}}$ (lux · sec) | 4.1 | |
| adhesivity to substrate | o | |
| adhesivity to CGL | o | |
| residual potential Vr (V) | o | |

TABLE 17

| | CTL | CGL |
|---|---|---|
| $C_8H_8$ (sccm) | 50 | |
| $H_2$ (sccm) | 0 | 210 |
| $GeH_4$ (sccm) | | |
| $SiH_4$ (sccm) | 20 | 90 |
| $N_2O$ (sccm) | | 1 |
| $H_2 + B_2H_6$ (sccm) | | |
| Power (W) | 7.5 | 10 |

TABLE 17-continued

| | CTL | CGL |
|---|---|---|
| inner pressure of reactor (Torr) | 0.25 | 0.5 |
| time | 2 (hour) | 40 (minute) |
| thickness of layer (μm) | 6.8 | 1 |
| Si content (atomic %) $= \frac{Si}{C + Si}$ | 5 | — |
| hydrogen content (atomic %) | 46 | — |
| $V_0$ (V) | −390 | |
| $E_{\frac{1}{2}}$ (lux · sec) | 2.1 | |
| adhesivity to substrate | o | |
| adhesivity to CGL | o | |
| residual potential Vr (V) | o | |

TABLE 18

| | CTL | CGL |
|---|---|---|
| $C_2H_4$ (sccm) | 30 | |
| $H_2$ (sccm) | 40 | |
| $GeH_4$ (sccm) | | |
| $SiH_4$ (sccm) | 3 | |
| $N_2O$ (sccm) | | |
| $H_2 + B_2H_6$ (sccm) | | |
| Power (W) | 100 | |
| inner pressure of reactor (Torr) | 0.5 | |
| time | 4 (hour) | |
| thickness of layer (μm) | 5 | |
| Si content (atomic %) $= \frac{Si}{C + Si}$ | 5 | |
| hydrogen content (atomic %) | 50 | |
| $V_0$ (V) | +260 | |
| $E_{\frac{1}{2}}$ (lux · sec) | 4.5 | |
| adhesivity to substrate | o | |
| adhesivity to CGL | o | |
| residual potential Vr (V) | o | |

TABLE 19

| | CTL | CGL |
|---|---|---|
| $C_3H_6$ (sccm) | 80 | |
| $H_2$ (sccm) | 20 | 210 |
| $GeH_4$ (sccm) | | |
| $SiH_4$ (sccm) | 12 | 90 |
| $N_2O$ (sccm) | | 1 |
| $H_2 + B_2H_6$ (sccm) | | |
| Power (W) | 200 | 10 |
| inner pressure of reactor (Torr) | 1.0 | 1.0 |
| time | 6 (hour) | 40 (minute) |
| thickness of layer (μm) | 7.3 | 0.5 |
| Si content (atomic %) $= \frac{Si}{C + Si}$ | 5 | — |
| hydrogen content (atomic %) | 60 | — |
| $V_0$ (V) | −430 | |
| $E_{\frac{1}{2}}$ (lux · sec) | 5.1 | |
| adhesivity to substrate | o | |
| adhesivity to CGL | o | |
| residual potential Vr | o | |

TABLE 19-continued

| | CTL | CGL |
|---|---|---|
| (V) | | |

TABLE 20

| | CTL | CGL |
|---|---|---|
| $C_2H_4$ (sccm) | 240 | |
| $H_2$ (sccm) | 320 | 210 |
| $GeH_4$ (sccm) | 4 | |
| $SiH_4$ (sccm) | | 90 |
| $N_2O$ (sccm) | | 1 |
| $H_2 + B_2H_6$ (sccm) | | |
| Power (W) | 800 | 10 |
| inner pressure of reactor (Torr) | 0.5 | 1.0 |
| time | 8 (hour) | 40 (minute) |
| thickness of layer (μm) | 17 | 0.5 |
| Ge content (atomic %) $= \frac{Ge}{C + Ge}$ | 4 | — |
| hydrogen content (atomic %) | 30 | — |
| $V_0$ (V) | −390 | |
| $E_{\frac{1}{2}}$ (lux · sec) | 5.2 | |
| adhesivity to substrate | o | |
| adhesivity to CGL | o | |
| residual potential Vr (V) | o | |

TABLE 21

| | CTL | CGL |
|---|---|---|
| $C_2H_4$ (sccm) | 180 | |
| $H_2$ (sccm) | 240 | 210 |
| $GeH_4$ (sccm) | 3 | |
| $SiH_4$ (sccm) | | 90 |
| $N_2O$ (sccm) | | 1 |
| $H_2 + B_2H_6$ (sccm) | | |
| Power (W) | 600 | 10 |
| inner pressure of reactor (Torr) | 0.5 | 1.0 |
| time | 8 (hour) | 40 (minute) |
| thickness of layer (μm) | 16 | 0.5 |
| Ge content (atomic %) $= \frac{Ge}{C + Ge}$ | 4 | — |
| hydrogen content (atomic %) | 37 | — |
| $V_0$ (V) | −450 | |
| $E_{\frac{1}{2}}$ (lux · sec) | 4.4 | |
| adhesivity to substrate | o | |
| adhesivity to CGL | o | |
| residual potential Vr (V) | o | |

TABLE 21

| | CTL | CGL |
|---|---|---|
| i-$C_4H_{10}$ (sccm) | 180 | |
| $H_2$ (sccm) | 120 | 210 |
| $GeH_4$ (sccm) | 6 | |
| $SiH_4$ (sccm) | | 90 |
| $N_2O$ (sccm) | | 1 |
| $H_2 + B_2H_6$ (sccm) | | |
| Power (W) | 500 | 10 |
| inner pressure of reactor (Torr) | 0.5 | 1.0 |
| time | 8 (hour) | 40 (minute) |
| thickness of layer (μm) | 10 | 0.5 |

TABLE 21-continued

| | CTL | CGL |
|---|---|---|
| Ge content (atomic %) $= \frac{Ge}{C + Ge}$ | 4 | — |
| hydrogen content (atomic %) | 45 | — |
| $V_0$ (V) | −330 | |
| $E_{\frac{1}{2}}$ (lux · sec) | 4.0 | |
| adhesivity to substrate | o | |
| adhesivity to CGL | o | |
| residual potential Vr (V) | o | |

TABLE 23

| | CTL | CGL |
|---|---|---|
| $C_8H_8$ (sccm) | 50 | |
| $H_2$ (sccm) | 0 | 210 |
| $GeH_4$ (sccm) | 3 | |
| $SiH_4$ (sccm) | | 90 |
| $N_2O$ (sccm) | | 1 |
| $H_2 + B_2H_6$ (sccm) | | |
| Power (W) | 75 | 10 |
| inner pressure of reactor (Torr) | 0.25 | 1.0 |
| time | 2 (hour) | 40 (minute) |
| thickness of layer (μm) | 6.8 | 0.5 |
| Ge content (atomic %) $= \frac{Ge}{C + Ge}$ | 4 | — |
| hydrogen content (atomic %) | 46 | — |
| $V_0$ (V) | −380 | |
| $E_{\frac{1}{2}}$ (lux · sec) | 2.0 | |
| adhesivity to substrate | o | |
| adhesivity to CGL | o | |
| residual potential Vr (V) | o | |

TABLE 24

| | CTL | CGL |
|---|---|---|
| $C_2H_4$ (sccm) | 30 | |
| $H_2$ (sccm) | 40 | |
| $GeH_4$ (sccm) | 0.5 | |
| $SiH_4$ (sccm) | | |
| $N_2O$ (sccm) | | |
| $H_2 + B_2H_6$ (sccm) | | |
| Power (W) | 100 | |
| inner pressure of reactor (Torr) | 0.5 | |
| time | 4 (hour) | |
| thickness of layer (μm) | 5 | |
| Ge content (atomic %) $= \frac{Ge}{C + Ge}$ | 4 | |
| hydrogen content (atomic %) | 50 | |
| $V_0$ (V) | +250 | |
| $E_{\frac{1}{2}}$ (lux · sec) | 4.4 | |
| adhesivity to substrate | o | |
| adhesivity to CGL | o | |
| residual potential Vr (V) | o | |

TABLE 25

| | CTL | CGL |
|---|---|---|
| $C_3H_6$ (sccm) | 80 | |
| $H_2$ (sccm) | 20 | 210 |

TABLE 25-continued

| | CTL | CGL |
|---|---|---|
| $GeH_4$ (sccm) | 2 | |
| $SiH_4$ (sccm) | | 90 |
| $N_2O$ (sccm) | | 1 |
| $H_2 + B_2H_6$ (sccm) | | |
| Power (W) | 200 | 10 |
| inner pressure of reactor (Torr) | 1.0 | 1.0 |
| time | 6 (hour) | 40 (minute) |
| thickness of layer (μm) | 7.3 | 0.5 |
| Ge content (atomic %) $= \frac{Ge}{C + Ge}$ | 4 | — |
| hydrogen content (atomic %) | 60 | — |
| $V_0$ (V) | −420 | |
| $E_{\frac{1}{2}}$ (lux · sec) | 5.0 | |
| adhesivity to substrate | o | |
| adhesivity to CGL | o | |
| residual potential Vr (V) | o | |

TABLE 26

| | CTL | CGL |
|---|---|---|
| $C_2H_4$ (sccm) | 240 | |
| $H_2$ (sccm) | 320 | 210 |
| $GeH_4$ (sccm) | | |
| $SiH_4$ (sccm) | | 90 |
| $N_2O$ (sccm) | | 1 |
| $H_2 + B_2H_6$ (sccm) | | |
| $S_n(CH_3)_4$ (sccm) | 1.2 | |
| Power (W) | 800 | 10 |
| inner pressure of reactor (Torr) | 0.5 | 1.0 |
| time | 8 (hour) | 40 (minute) |
| thickness of layer (μm) | 17 | 0.5 |
| Sn content (atomic %) $= \frac{Sn}{C + Sn}$ | 2 | — |
| hydrogen content (atomic %) | 30 | — |
| $V_0$ (V) | −380 | |
| $E_{\frac{1}{2}}$ (lux · sec) | 5.1 | |
| adhesivity to substrate | o | |
| adhesivity to CGL | o | |
| residual potential Vr (V) | o | |

TABLE 27

| | CTL | CGL |
|---|---|---|
| $C_2H_4$ (sccm) | 180 | |
| $H_2$ (sccm) | 240 | 210 |
| $GeH_4$ (sccm) | | |
| $SiH_4$ (sccm) | | 90 |
| $N_2O$ (sccm) | | 1 |
| $H_2+B_2H_6$ (sccm) | | |
| $S_n(CH_3)_4$ (sccm) | 0.45 | |
| Power (W) | 600 | 10 |
| inner pressure of reactor (Torr) | 0.5 | 1.0 |
| time | 8 (hour) | 40 (minute) |
| thickness of layer (μm) | 16 | 0.5 |
| Sn content (atomic %) $= \frac{Sn}{C + Sn}$ | 2 | — |
| hydrogen content (atomic %) | 37 | — |
| $V_0$ (V) | −440 | |
| $E_{\frac{1}{2}}$ (lux · sec) | 4.5 | |

TABLE 27-continued

| | CTL | CGL |
|---|---|---|
| adhesivity to substrate | o | |
| adhesivity to CGL | o | |
| residual potential Vr (V) | o | |

TABLE 28

| | CTL | CGL |
|---|---|---|
| i-$C_4H_{10}$ (sccm) | 180 | |
| $H_2$ (sccm) | 120 | 210 |
| $GeH_4$ (sccm) | | |
| $SiH_4$ (sccm) | | 90 |
| $N_2O$ (sccm) | | 1 |
| $H_2+B_2H_6$ (sccm) | | |
| $S_n(CH_3)_4$ (sccm) | 1.8 | |
| Power (W) | 500 | 10 |
| inner pressure of reactor (Torr) | 0.5 | 1.0 |
| time | 8 (hour) | 40 (minute) |
| thickness of layer (μm) | 10 | 0.5 |
| Sn content (atomic %) $= \frac{Sn}{C + Sn}$ | 2 | — |
| hydrogen content (atomic %) | 45 | — |
| $V_0$ (V) | −320 | |
| $E_{\frac{1}{2}}$ (lux · sec) | 3.9 | |
| adhesivity to substrate | o | |
| adhesivity to CGL | o | |
| residual potential Vr (V) | o | |

TABLE 29

| | CTL | CGL |
|---|---|---|
| $C_8H_8$ (sccm) | 50 | |
| $H_2$ (sccm) | 0 | 210 |
| $GeH_4$ (sccm) | | |
| $SiH_4$ (sccm) | | 90 |
| $N_2O$ (sccm) | | 1 |
| $H_2+B_2H_6$ (sccm) | | |
| $S_n(CH_3)_4$ (sccm) | 1.0 | |
| Power (W) | 75 | 10 |
| inner pressure of reactor (Torr) | 0.25 | 1.0 |
| time | 2 (hour) | 40 (minute) |
| thickness of layer (μm) | 6.8 | 0.5 |
| Sn content (atomic %) $= \frac{Sn}{C + Sn}$ | 2 | — |
| hydrogen content (atomic %) | 46 | — |
| $V_0$ (V) | −370 | |
| $E_{\frac{1}{2}}$ (lux · sec) | 2.0 | |
| adhesivity to substrate | o | |
| adhesivity to CGL | o | |
| residual potential Vr (V) | o | |

TABLE 30

| | CTL | CGL |
|---|---|---|
| $C_2H_4$ (sccm) | 30 | |
| $H_2$ (sccm) | 40 | |
| $GeH_4$ (sccm) | | |
| $SiH_4$ (sccm) | | |
| $N_2O$ (sccm) | | |
| $H_2+B_2H_6$ (sccm) | | |
| $S_n(CH_3)_4$ (sccm) | 0.15 | |
| Power (W) | 100 | |
| inner pressure of | 0.5 | |

TABLE 30-continued

| | CTL | CGL |
|---|---|---|
| reactor (Torr) | | |
| time | 4 (hour) | |
| thickness of layer (μm) | 5 | |
| Sn content (atomic %) = $\frac{Sn}{C + Sn}$ | 2 | |
| hydrogen content (atomic %) | 50 | |
| $V_0$ (V) | +240 | |
| $E_{\frac{1}{2}}$ (lux · sec) | 4.6 | |
| adhesivity to substrate | o | |
| adhesivity to CGL | o | |
| residual potential Vr (V) | o | |

TABLE 31

| | CTL | CGL |
|---|---|---|
| $C_3H_6$ (sccm) | 80 | |
| $H_2$ (sccm) | 20 | 210 |
| $GeH_4$ (sccm) | | |
| $SiH_4$ (sccm) | | 90 |
| $N_2O$ (sccm) | | 1 |
| $H_2+B_2H_6$ (sccm) | | |
| $S_n(CH_3)_4$ (sccm) | 0.6 | |
| Power (W) | 200 | 10 |
| inner pressure of reactor (Torr) | 1.0 | 1.0 |
| time | 6 (hour) | 40 (minute) |
| thickness of layer (μm) | 7.3 | 0.5 |
| Sn content (atomic %) = $\frac{Sn}{C + Sn}$ | 2 | — |
| hydrogen content (atomic %) | 60 | — |
| $V_0$ (V) | −410 | |
| $E_{\frac{1}{2}}$ (lux · sec) | 5.1 | |
| adhesivity to substrate | o | |
| adhesivity to CGL | o | |
| residual potential Vr (V) | o | |

TABLE 32

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | 0 | 90 |
| $N_2O$ (sccm) | | 1 |
| $H_2+B_2H_6$ (sccm) | | 210 ($B_2H_6/SiH_4$ = 1 ppm) |
| Power (W) | 100 | 20 |
| inner pressure of reactor (Torr) | 1.2 | 1.0 |
| time | 5 (hour) | 20 (minute) |
| thickness of layer (μm) | 5 | 1 |
| Si content (atomic %) = $\frac{Si}{C + Si}$ | 0 | — |
| hydrogen content (atomic %) | 50 | — |
| $V_0$ (V) | +340 | |
| $E_{\frac{1}{2}}$ (lux · sec) | 7.0 | |
| adhesivity to substrate | x | |
| adhesivity to CGL | Δ | |
| residual potential Vr (V) | x | |

TABLE 33

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | 5 | 90 |
| $N_2O$ (sccm) | | 1 |
| $H_2+B_2H_6$ (sccm) | | 210 ($B_2H_6/SiH_4$ = 1 ppm) |
| Power (W) | 100 | 20 |
| inner pressure of reactor (Torr) | 1.2 | 1.0 |
| time | 5 (hour) | 20 (minute) |
| thickness of layer (μm) | 5 | 1 |
| Si content (atomic %) = $\frac{Si}{C + Si}$ | 15 | — |
| hydrogen content (atomic %) | 50 | — |
| $V_0$ (V) | +370 | |
| $E_{\frac{1}{2}}$ (lux · sec) | >10 | |
| adhesivity to substrate | o | |
| adhesivity to CGL | o | |
| residual potential Vr (V) | x | |

TABLE 34

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | 10 | 90 |
| $N_2O$ (sccm) | | 1 |
| $H_2+B_2H_6$ (sccm) | | 210 ($B_2H_6/SiH_4$ = 1 ppm) |
| Power (W) | 100 | 20 |
| inner pressure of reactor (Torr) | 1.2 | 1.0 |
| time | 5 (hour) | 20 (minute) |
| thickness of layer (μm) | 5 | 1 |
| Si content (atomic %) = $\frac{Si}{C + Si}$ | 20 | — |
| hydrogen content (atomic %) | 50 | — |
| $V_0$ (V) | +350 | |
| $E_{\frac{1}{2}}$ (lux · sec) | >10 | |
| adhesivity to substrate | o | |
| adhesivity to CGL | o | |
| residual potential Vr (V) | x | |

TABLE 35

| | CTL | CGL |
|---|---|---|
| $C_2H_4$ (sccm) | 60 | |
| $H_2$ (sccm) | 80 | |
| $GeH_4$ (sccm) | 0 | |
| $SiH_4$ (sccm) | | 90 |
| $N_2O$ (sccm) | | 1 |
| $H_2+B_2H_6$ (sccm) | | 210 ($B_2H_6/SiH_4$ = 1 ppm) |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Ge content (atomic %) = $\frac{Ge}{C + Ge}$ | 0 | — |
| hydrogen content (atomic %) | 50 | — |
| $V_0$ (V) | +680 | |
| $E_{\frac{1}{2}}$ (lux · sec) | 7.0 | |

TABLE 35-continued

| | CTL | CGL |
|---|---|---|
| adhesivity to substrate | | x |
| adhesivity to CGL | | Δ |
| residual potential Vr (V) | | x |

TABLE 36

| | CTL | CGL |
|---|---|---|
| $C_2H_4$ (sccm) | 60 | |
| $H_2$ (sccm) | 80 | |
| $GeH_4$ (sccm) | 3.5 | |
| $SiH_4$ (sccm) | | 90 |
| $N_2O$ (sccm) | | 1 |
| $H_2+B_2H_6$ (sccm) | | 210 ($B_2H_6/SiH_4$ = 1 ppm) |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Ge content (atomic %) = $\frac{Ge}{C+Ge}$ | 15 | — |
| hydrogen content (atomic %) | 50 | — |
| $V_0$ (V) | | +40 |
| $E_{\frac{1}{2}}$ (lux · sec) | | >10 |
| adhesivity to substrate | | o |
| adhesivity to CGL | | o |
| residual potential Vr (V) | | o |

TABLE 37

| | CTL | CGL |
|---|---|---|
| $C_2H_4$ (sccm) | 60 | |
| $H_2$ (sccm) | 80 | |
| $GeH_4$ (sccm) | 6.5 | |
| $SiH_4$ (sccm) | | 90 |
| $N_2O$ (sccm) | | 1 |
| $H_2+B_2H_6$ (sccm) | | 210 ($B_2H_6/SiH_4$ = 1 ppm) |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Ge content (atomic %) = $\frac{Ge}{C+Ge}$ | 20 | — |
| hydrogen content (atomic %) | 50 | — |
| $V_0$ (V) | | 0 |
| $E_{\frac{1}{2}}$ (lux · sec) | | — |
| adhesivity to substrate | | o |
| adhesivity to CGL | | o |
| residual potential Vr (V) | | — |

TABLE 38

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | | 90 |
| $N_2O$ (sccm) | | 1 |
| $H_2+B_2H_6$ (sccm) | | 210 ($B_2H_6/SiH_4$ = 1 ppm) |
| $S_n(CH_3)_4$ (sccm) | 2.3 | |
| Power (W) | 100 | 20 |

TABLE 38-continued

| | CTL | CGL |
|---|---|---|
| inner pressure of reactor (Torr) | 1.2 | 1.0 |
| time | 10 (hour) | 20 (minute) |
| thickness of layer (μm) | 10 | 1 |
| Sn content (atomic %) = $\frac{Sn}{C+Sn}$ | 15 | — |
| hydrogen content (atomic %) | 50 | — |
| $V_0$ (V) | | +40 |
| $E_{\frac{1}{2}}$ (lux · sec) | | >10 |
| adhesivity to substrate | | o |
| adhesivity to CGL | | o |
| residual potential Vr (V) | | o |

TABLE 39

| | CTL | CGL |
|---|---|---|
| $C_2H_4$ (sccm) | 60 | |
| $H_2$ (sccm) | 80 | |
| $GeH_4$ (sccm) | | |
| $SiH_4$ (sccm) | | 90 |
| $N_2O$ (sccm) | | 1 |
| $H_2+B_2H_6$ (sccm) | | 210 ($B_2H_6/SiH_4$ = 1 ppm) |
| $S_n(CH_3)_4$ (sccm) | 4.0 | |
| Power (W) | 100 | 20 |
| inner pressure of reactor (Torr) | 1.2 | 1.0 |
| time | 10 (hour) | 20 (minute) |
| thickness of layer (μm) | 10 | 1 |
| Sn content (atomic %) = $\frac{Sn}{C+Sn}$ | 20 | — |
| hydrogen content (atomic %) | 50 | — |
| $V_0$ (V) | | 0 |
| $E_{\frac{1}{2}}$ (lux · sec) | | — |
| adhesivity to substrate | | o |
| adhesivity to CGL | | o |
| residual potential Vr (V) | | — |

What is claimed is:

1. A photosensitive member comprising:
an electrically conductive substrate;
a charge generating layer; and
a charge transporting layer comprising amorphous carbon containing hydrogen, the hydrogen content of which is from 0.1 to 67 atomic percent based on the amount of all atoms contained in said charge transporting layer, and at least one element selected from the group consisting of Si, Ge and Sn at a content of less than about 10 atomic percent based on the amount of carbon and elements contained in said charge transporting layer, and said charge transporting layer having a relative dielectric constant of 2.0 to 6.0.

2. A photosensitive member of claim 1, in which the charge transporting layer has a thickness of about 5 to 50 μm.

3. A photosensitive member of claim 1, in which the hydrogen content is preferably about 30 to about 60 atomic percent based on all the atoms therein.

4. A photosensitive member of claim 1, in which the charge transporting layer is formed by organic plasma polymerization.

5. A photosensitive member of claim 1, in which the charge transporting layer has an optical energy gap of 1.5 to 3.0 eV.

6. A photosensitive member comprising:

an electrically conductive substrate;

a charge generating layer; and a charge transporting layer comprising amorphous carbon containing hydrogen, the hydrogen content of which is from 0.1 to 67 atomic percent based on the amount of all atoms contained in said charge transporting layer, and at least one element selected from the group consisting of Si, Ge and Sn at a content of less than about 10 atomic percent based on the amount of carbon and elements contained in said charge transporting layer.

* * * * *